US006726187B2

(12) United States Patent
Ye et al.

(10) Patent No.: US 6,726,187 B2
(45) Date of Patent: Apr. 27, 2004

(54) HUMIDIFIER

(75) Inventors: Jianming Ye, North York (CA); Todd A. Simpson, Brampton (CA); Joseph Cargnelli, Toronto (CA)

(73) Assignee: Hydrogenics Corporation, Mississauga (CA)

( * ) Notice: Subject to any disclaimer, the term of this patent is extended or adjusted under 35 U.S.C. 154(b) by 0 days.

(21) Appl. No.: 09/984,643

(22) Filed: Oct. 30, 2001

(65) Prior Publication Data

US 2003/0080447 A1 May 1, 2003

(51) Int. Cl.[7] ..... B01F 3/04

(52) U.S. Cl. ..... 261/94; 261/113; 261/118; 261/123

(58) Field of Search ..... 261/94, 113, 118, 261/123, 115, 117; 96/276, 277, 280, 294, 297, 351

(56) References Cited

U.S. PATENT DOCUMENTS

| | | | | |
|---|---|---|---|---|
| 920,295 | A | * | 5/1909 | Emerson |
| 965,090 | A | * | 7/1910 | Dlouhy |
| 1,112,860 | A | * | 10/1914 | Smith |
| 1,588,833 | A | * | 6/1926 | Hogan et al. |
| 2,239,595 | A | | 2/1941 | Cummings |
| 3,105,103 | A | * | 9/1963 | Old |
| 3,556,734 | A | * | 1/1971 | Peterson |
| 3,983,190 | A | | 9/1976 | Norbäck |
| 4,017,280 | A | * | 4/1977 | Cleman et al. |
| 4,056,049 | A | | 11/1977 | Stuckey |
| 4,334,897 | A | * | 6/1982 | Brady et al. |
| 5,348,691 | A | | 9/1994 | McElroy et al. |
| 5,769,067 | A | | 6/1998 | Mandeville et al. |
| 6,032,932 | A | | 3/2000 | Sixsmith |
| 6,135,432 | A | | 10/2000 | Hebblewhite et al. |
| 6,267,804 | B1 | * | 7/2001 | Marlowe |
| 6,355,096 | B1 | * | 3/2002 | Schmidtke |
| 6,451,268 | B1 | * | 9/2002 | Erdman |

FOREIGN PATENT DOCUMENTS

| | | |
|---|---|---|
| GB | 583435 | 12/1946 |
| WO | WO 9522724 | 8/1995 |

* cited by examiner

*Primary Examiner*—Scott Bushey
(74) *Attorney, Agent, or Firm*—Bereskin & Parr

(57) ABSTRACT

The present Invention relates to a humidifier that has a housing defining a chamber having at least one open end. The housing is provided with a gas inlet connectable in fluid communication with a source of gas having a first moisture content, and a gas outlet connectable with a passageway for the withdrawal of a gas having a second moisture content greater than the first moisture content. The humidifier also has at least one fluid distributing portion disposed within the at least one open end of the housing to continuously distribute a fluid within the chamber, and at least one baffle disposed within the housing to define a flow path for the gas to be humidified. During operation, the gas absorbs at least a portion of the fluid as the fluid is being continuously distributed in the chamber thereby increasing the moisture content of the gas as it travels from the gas inlet towards the gas outlet. Packing material can be provided in the housing to further increase the contact area between the gas and the water, if desired.

23 Claims, 6 Drawing Sheets

HUMIDIFIER

FIELD OF THE INVENTION

The present invention generally relates to a humidifier. More particularly, the present invention relates to a compact gas humidifying device having a long flow path and packing materials.

BACKGROUND OF THE INVENTION

There are a variety of devices used to humidify gases in domestic applications and industrial applications. Examples of known humidifying devices include bubbler humidifiers, packed column humidifiers, membrane humidifiers, etc.

One known type of humidifier uses water injection to humidify the gas. The humidifier has a generally hollow cylindrical body and a plurality of water injection nozzles for injecting water into the hollow cylindrical body. The water injection nozzles are typically provided on one side wall of the hollow cylindrical body. Dry gas enters the humidifier through a gas inlet provided at one end of the hollow cylindrical body and flows along the axial direction of the hollow cylindrical body to the opposite end. As the gas flows through the hollow cylindrical body water is injected into the hollow of the body through the plurality of injection nozzles, humidifying the gas. The humidified gas then leaves the hollow cylindrical body through a gas outlet provided at the opposite end of the hollow cylindrical body. The flow path of the gas is relatively short with little contact area between the gas and the water. In order to increase the flow path and contact area between the gas and the water the device tends to be large.

Another known type of humidifier uses a packing material to increase the contact area between the gas and the water. Examples of this type of humidifier have been disclosed in U.S. Pat. Nos. 3,983,190 and 5,769,067. The humidifier has a generally hollow cylindrical body and is disposed in a substantially vertical position. The gas enters the hollow cylindrical body from a gas inlet provided on a bottom wall of the hollow cylindrical body, and is forced to flow upwardly along the axial direction of the hollow cylindrical body by a blower or fan. A water inlet is provided on a top wall of the hollow cylindrical body to dispense water to a water distribution plate that is disposed within the hollow cylindrical body generally parallel to and near the top wall. A plurality of holes are provided in the water distribution plate so that water coming from the water inlet can drip down through the holes to humidify the gas flowing upwardly through the hollow cylindrical body. A packing material can be packed between the water distribution plate and the bottom wall to increase the contact area between the gas and the water.

A humidifier employing a water permeable membrane is disclosed in U.S. Pat. No. 5,348,691. Passages for the gas to be humidified and passages for water are provided on opposite sides of a membrane. As the gas flows along the passages on one side of the membrane water, flowing through the passages on the other side of the membrane, permeates through the membrane to humidify the gas.

SUMMARY OF THE INVENTION

In accordance with the present invention, a humidifier is provided having a housing defining a chamber. The housing is provided with a gas inlet to the chamber and a gas outlet from the chamber and at least one fluid distributing portion connected to the housing to distribute a fluid within the chamber. At least one baffle is disposed within the chamber to define a flow path for the gas between the gas inlet and the gas outlet. The present invention is described using humidifying air with water as an example. It can be appreciated, however, that the present invention can also be used to humidify other gases or fluids and to exchange heat.

In one embodiment the at least one baffle comprises a plurality of baffles plates. In particular, the baffle plates are disposed within the chamber generally transverse to the fluid distributing portion and spaced from one another over a longitudinal extent of the fluid distributing portion. The extent of the baffle plates in the direction generally transverse to the fluid distributing portion is sufficient to define within the chamber gas flow paths adjacent the baffle plates. Each baffle plate can have a top edge and a bottom edge and a width, with the width being substantially the same as the width of the side walls of the chamber, that is to say, for the embodiment disclosed, the baffle plates extend from one side wall of the chamber to the other side wall. The baffle plates can be of various shapes and it is not necessary that the baffle plates be similar in shape and dimension to each other. For the embodiment disclosed the baffle plates have generally the same shape and dimension.

Each baffle plate is provided with an opening to allow gas to flow between adjacent flow paths. The opening of a given baffle plate is at an end of the baffle plate that is opposed to the end of where an opening of an adjacent baffle plate is provided.

In the embodiment disclosed the opening is provided by spacing an end of the baffle plate from at least one of the fluid distributing portions and the inner walls of the chamber. Moreover, adjacent baffle plates are positioned within the chamber so as to be offset with respect to one another in a direction generally transverse to the fluid distributing portion. This presents the opening of a given baffle plate in opposition to where an opening of an adjacent baffle plate is provided.

Moreover, at least some of the baffle plates can be provided with an aperture to allow fluid to flow between adjacent flow paths.

Further, the baffle plates can be disposed within the chamber at generally 90° to the fluid distributing portion.

The chamber of the humidifier can also be contain a packing material, such as, for example, metal chips, plastic chips, or any other suitable random or structured packing material. The packing material can fill two thirds of the chamber of the housing.

Further, at least one port can be provided to connect the fluid distributing portion to an external fluid source. At least one fluid distributing port can also be provided to distribute the fluid to the chamber, and a at least one fluid passage to connect the ports to the fluid distributing ports. The fluid distributing ports can be provided with fluid spraying nozzles. A fluid level sensor to monitor the fluid level in the chamber can also be provided.

The housing is open at least one end and the fluid distributing portion is disposed within the open end of the housing. In one embodiment the housing is disposed so that the at least one open end faces upwardly. In another embodiment the housing is disposed so that at least one open end faces a side thereof. In yet a further embodiment the housing is disposed so that one open end faces one side thereof and a another open end faces an opposed side thereof. For each of these embodiments the water distributing portion can be disposed over the open end of the housing.

Further the housing and the fluid distributing portion can be generally rectangular in shape. Similarly the chamber can be generally rectangular in shape. The gas inlet and the gas outlet can be provided at opposite ends of the housing.

For a better understanding of the present invention, and to show more clearly how it may be carried into effect, reference will now be made to the accompanying drawings, which show, by way of example, preferred embodiments of the present invention.

DETAILED DESCRIPTION OF THE INVENTION

Figure 10A:
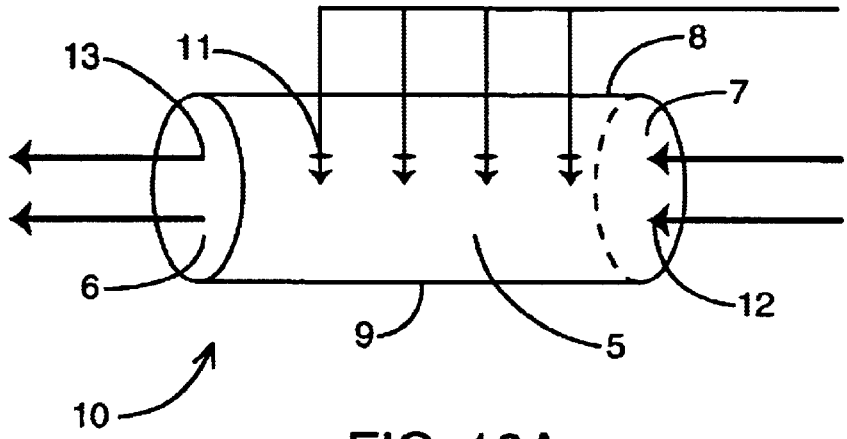
FIG. 10A PRIOR ART
FIG. 10*a* shows a schematic view of one example of conventional humidifiers.
Figure 10B:
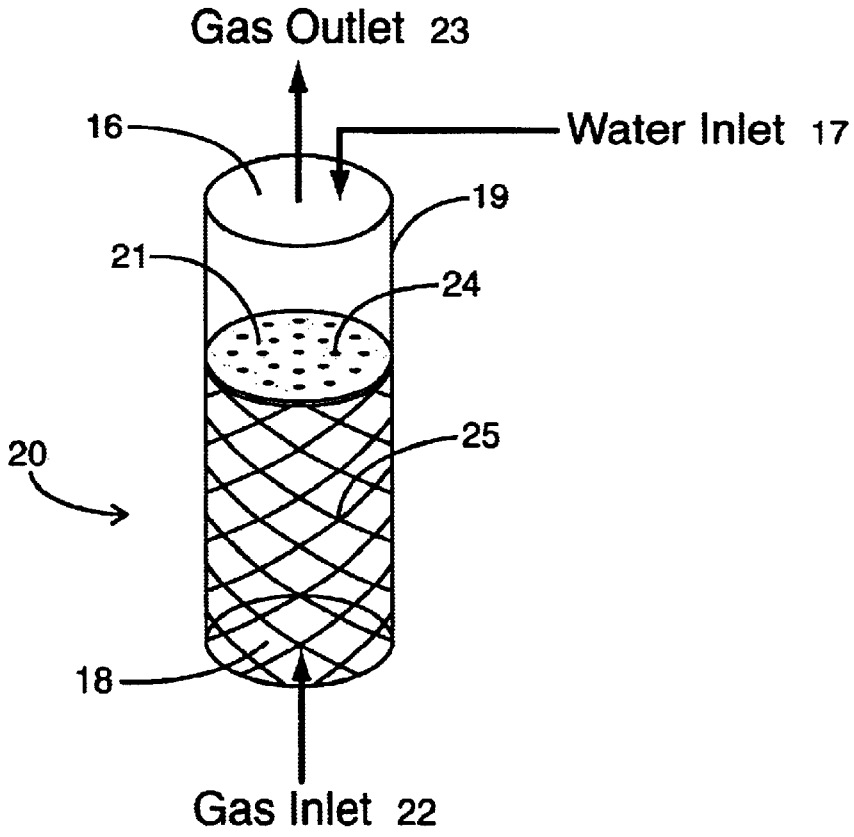
FIG. 10B PRIOR ART
FIG. 10*b* shows a schematic view of another example of conventional humidifiers.

FIGS. 10*a* and 10*b* show two types of conventional humidifiers. In particular, FIG. 10*a* shows a humidifier that does not use a packing material, while FIG. 10*b* shows a humidifier that uses a packing material.

Referring to FIG. 10*a*, the humidifier 10 has a generally hollow cylindrical body 9 and a plurality of water injection nozzles 11 for injecting water into the hollow cylindrical body 9. The water injection nozzles 11 are typically provided on the side wall 8 of the hollow cylindrical body 9. Gas enters the humidifier through a gas inlet 12 provided at one end 7 of the hollow cylindrical body 9 and flows along the axial direction of the hollow cylindrical body 9 to exit through a gas outlet 13 provided at the opposite end 6. As the gas flows through the hollow cylindrical body 9, water is injected into the hollow 5 of the body 9 through the plurality of nozzles 11, humidifying the gas. The humidified gas then leaves the hollow cylindrical body 9 through the gas outlet 13 provided on the end wall 6.

FIG. 10*b* shows another design of a conventional humidifier 20 that uses a suitable packing material 25 to increase the contact area between the gas and the water. Humidifier 20 has a generally hollow cylindrical body 19 that is disposed in a substantially vertical position. The gas enters the hollow cylindrical body 19 from a gas inlet 22 provided on a bottom wall 18 of the hollow cylindrical body 19, and is forced to flow upwardly along the axial direction of the hollow cylindrical body 19 by a blower or fan (not illustrated). A water inlet 17 is provided on a top wall 16 of the hollow cylindrical body 19 to dispense water to a water distribution plate 21 that is disposed within the hollow cylindrical body 19 generally parallel to and near the top wall 16. A plurality of holes 24 are provided in the water distribution plate 21 so that water coming from the water inlet 17 can drip down through the holes 24 to humidify the gas flowing upwardly through the hollow cylindrical body 19. Packing material 25 can be packed between the water distribution plate 21 and the bottom wall 18 to increase the contact area between the gas and the water.

Figure 1:
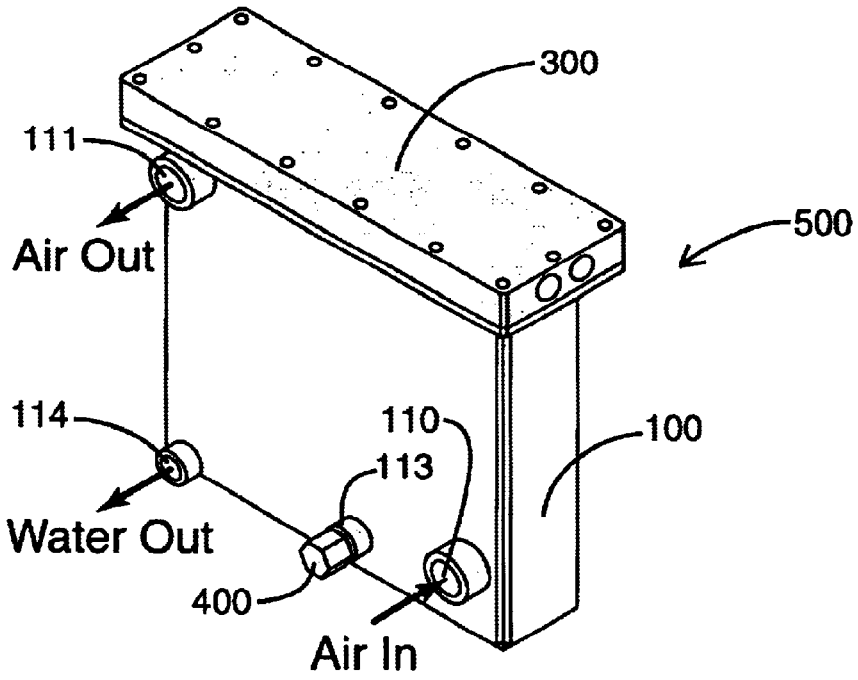
FIG. 1 is a perspective view illustrating the first embodiment of the humidifier in accordance with the present invention.

FIG. 1 shows a first embodiment of the humidifier 500 of the present invention. Hereinafter, the present invention will be described using humidifying air with water as an example. It should be appreciated, however, that the present invention can also be used to humidify other gases or fluids and to exchange heat.

Figure 2:
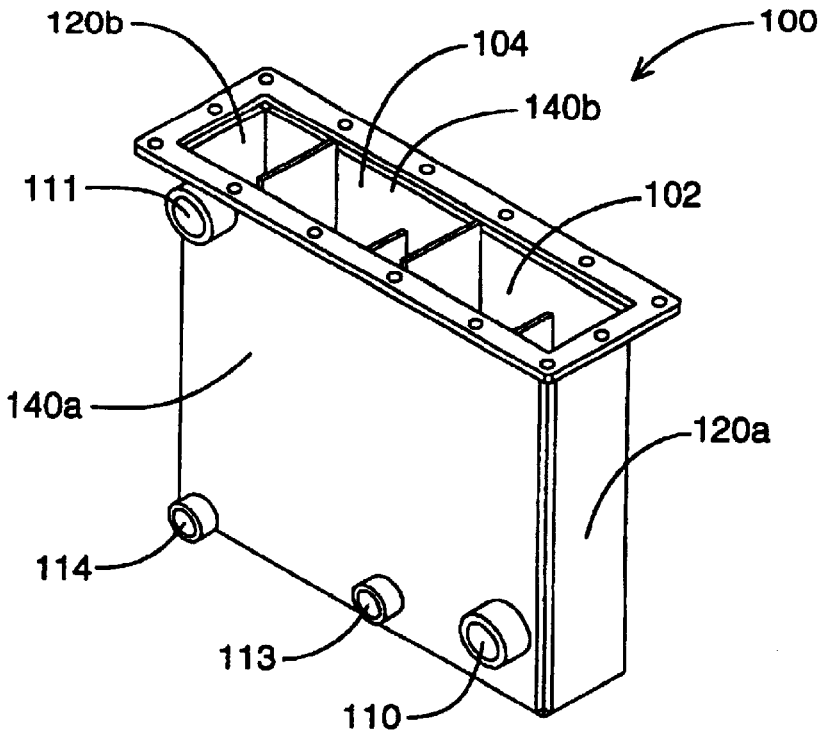
FIG. 2 is a perspective view illustrating the housing of the humidifier in the first embodiment in accordance with the present invention.

The humidifier 500 generally consists of a housing 100 and a water distributing portion 300. As shown in FIG. 2, the housing 100 of the humidifier 500 is generally rectangular in shape. The housing 100 has four side walls, namely a first pair of opposite side walls 120*a*, 120*b* and a second pair of opposite side wall 140*a*, 140*b*, and a bottom wall 160, defining an inner space or chamber 102 open along the top, as at 104. As shown in FIG. 2, in this embodiment, the side walls 140*a*, 140*b* have a greater length than the side walls 120*a* and 120*b*.

One of the side walls 140*a* is provided with four connector portions, specifically, an air inlet 110, an air outlet 111, a water outlet 114, and a connector 113 for a water level sensor (not illustrated). Each of the connector portions is in fluid communication with chamber 102 of the housing 100 so that the air and water can flow through the respective connector portions into or out of the chamber 102 of the housing 100.

A flange portion 180 is provided around the open top 104 of the housing 100. The flange portion 180 extends substantially perpendicular from the side walls 120*a*, 120*b* and 140*a*, 140*b* to form a planar surface 181 to receive the water distributing portion 300. A plurality of through holes 190 are spaced evenly on the planar surface 181 to receive a plurality of bolts (not shown) used to attach the water distributing portion 300 onto the flange portion 180 of the housing 100.

Figure 3:
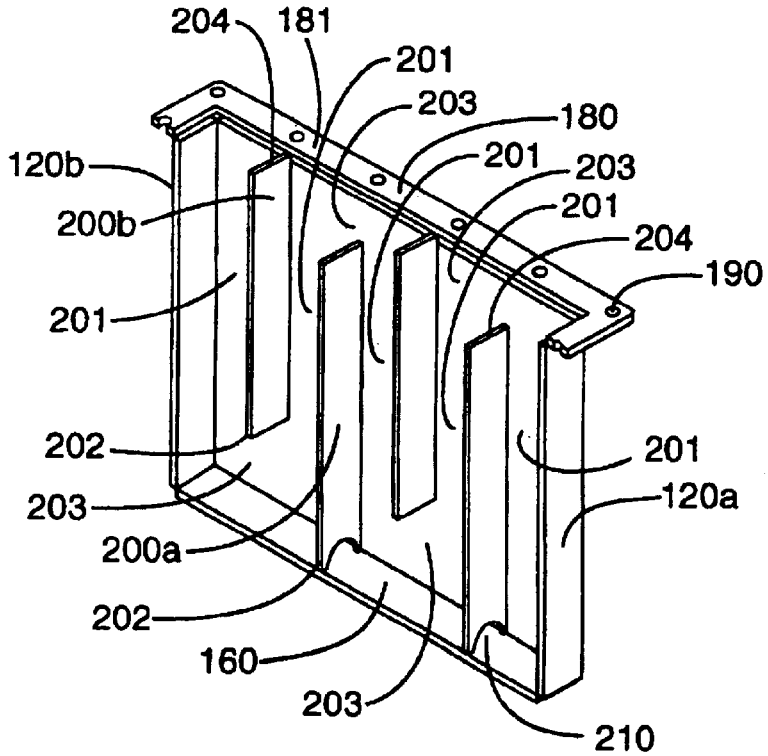
FIG. 3 is a perspective longitudinal section view illustrating the housing of the humidifier in the first embodiment in accordance with the present invention.

Referring to FIG. 3, a plurality of spaced baffle plates 200*a*, 200*b* are provided in the chamber 102 of the housing 100. Each of the baffle plates 200*a*, 200*b* is provided with a top edge 204 and a bottom edge 202. The baffle plates 200*a*, 200*b* have substantially the same width as that of the side walls 120*a*, 120*b*, that is to say, for the embodiment disclosed, the baffle plates 200*a*, 200*b* extend from one side wall 140*a* to the other side wall 140*b* and are substantially parallel to the side walls 120*a* and 120*b*. Moreover, the baffle plates 200*a*, 200*b* extend nearly the height of the housing 100, and are spaced from each other along the length of the housing 100. The extent of the baffle plates 200*a*, 200*b* with the chamber 102 is sufficient to define gas flow paths 201 adjacent the respective baffle plates 200*a*, 200*b*. It is to be understood that the baffle plates 200*a*, 200*b* can be of various shapes and it is not necessary that the baffle plates

200*a*, 200*b* be similar in shape and dimension to each other. For the embodiment disclosed, the baffle plates 200*a*, 200*b* have generally the same shape and dimension.

Each of the baffle plates 200*a*, 200*b* is provided with an opening 203 to allow gas to flow between adjacent flow paths 201. For the embodiment disclosed, the opening is defined by spacing an end of the baffle plates 200*a*, 200*b* from at least one of the fluid distributing portions 300 and inner walls of the chamber 102, as will hereinafter be described. Moreover, the opening of a given baffle plate is at an end of the baffle plate that is opposed to the end of where an opening of an adjacent baffle plate is provided.

Preferably, the baffle plates 200*a*, 200*b* are positioned within the chamber 102 of the housing 100 so that adjacent baffle plates are offset with respect to the height of the housing. Baffle plates 200*a* are positioned with one end 202 adjacent the bottom wall 160 of the housing 100 and with the other end 204 spaced from the planar surface 181 of the flange portion 180. This defines the opening 203 for baffle plates 200*a* between end 204 and the planar surface 181 of the flange portion 180. Baffle plates 200*b* are positioned with the end 204 adjacent the planar surface 181 and with the other end 202 spaced from the bottom wall 160 of the housing 100. This defines the opening 203 for baffle plates 200*b* between end 202 and the bottom well 160 of the housing 100. By so alternating the positioning of the baffles plates 200*a*, 200*b* along the length of the housing 100, a tortuous gas flowing path is defined from the air inlet 110 to the air outlet 111. For the embodiment illustrated the bottom end 202 of each baffle plate 200*a* that is connected to the bottom wall 160 is provided with an aperture 210 to permit water to flow through as will hereinafter be described.

Figure 5:
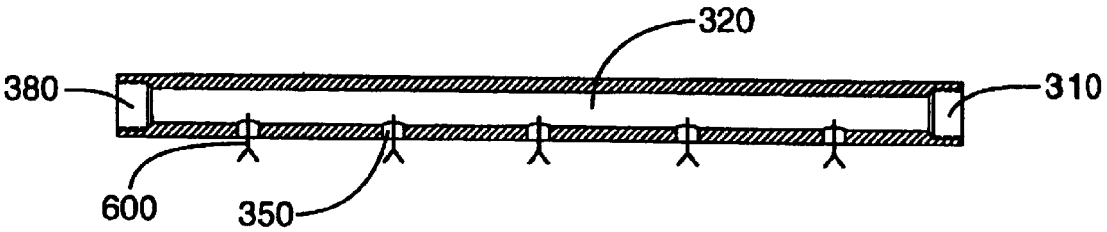
FIG. 5 is a longitudinal section view illustrating the water distributing portion of the humidifier in the first embodiment in accordance with the present invention.
Figure 6:
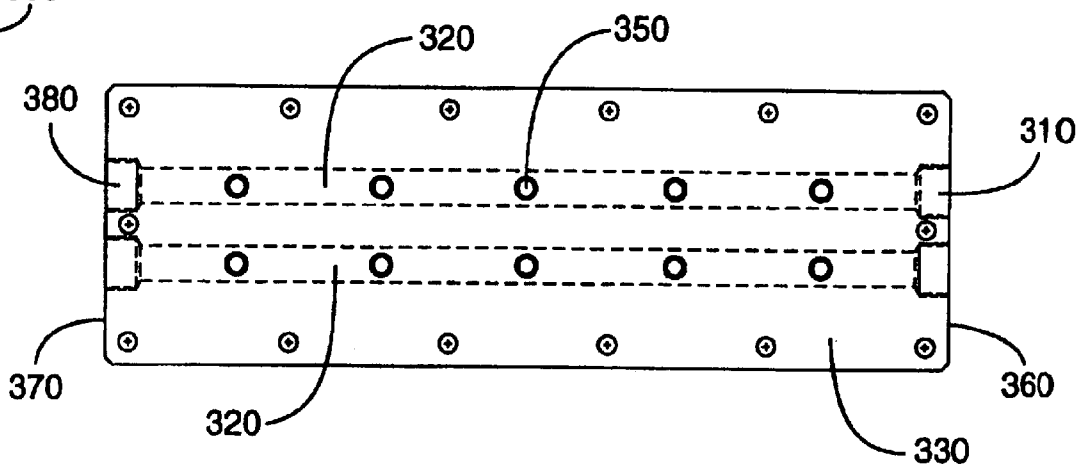
FIG. 6 is a plan view illustrating the water distributing portion of the humidifier in the first embodiment in accordance with the present invention.
Figure 4:
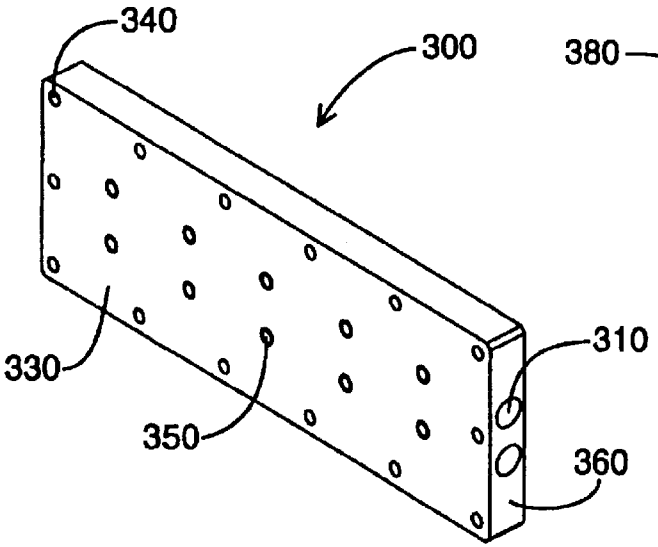
FIG. 4 is a perspective view illustrating the water distributing portion of the humidifier in the first embodiment in accordance with the present invention.

Now referring to FIGS. 4–6, the water distributing portion 300 is shown generally in the form of a rectangular plate having a certain thickness. The water distributing portion 300 has at least one internal fluid passage 320. For the embodiment illustrated, the water distributing portion 300 has two internal passages 320 extending parallel to each other and to the length of the water distribution portion 300. More fluid passages can be provided where necessary, for example, where the housing 100 has a greater width.

Ports 310 to the internal passages 320 are provided on one end wall 360 of the water distribution portion 300. Similarly, two ports 380 to the internal passages 320 may be provided on the opposite end wall 370 of the water distribution portion 300. This provides mounting flexibility so that the water distribution portion 300 can be connected to external ducts or hoses at either or both ends.

The facing 330 of the water distribution portion 300 that is in contact with the planar surface 181 of the flange portion 180 of the housing 100 is provided with a plurality of through holes 340 and a plurality of water distributing ports 350. The through holes 340 are arranged to correspond with the through holes 190 on the flange portion 180 so that fastening means, such us bolts (not Illustrated), can be inserted In the through holes to attach the water distributing portion 300 to the flange portion 180 of the housing 100. Sealing means (not illustrated), such as gaskets, can be provided between the wall 330 and the flange portion 180 to prevent leakage of water, gas or a mixture thereof. Each of the ports 310 or 380 is in fluid communication with its corresponding internal fluid passage 320. Moreover, the water distributing ports 350 are provided In the wall 330 to be in fluid communication with the internal fluid passages 320. In the embodiment illustrated, a simple arrangement is shown. Specifically, each internal fluid passage 320 is straight and the water distributing ports 350 are arranged along lines corresponding to the Internal fluid passages 320, as shown in FIG. 4 and FIG. 6. More preferably, water distributing ports 350 are threaded holes and water spraying nozzles 600 (illustrated in FIG. 5) are mounted in the water distributing ports 350 by means of a suitable threaded connection. The water spraying nozzles 600 spray water mist into the inner space 102 of the housing 100.

Figure 7:
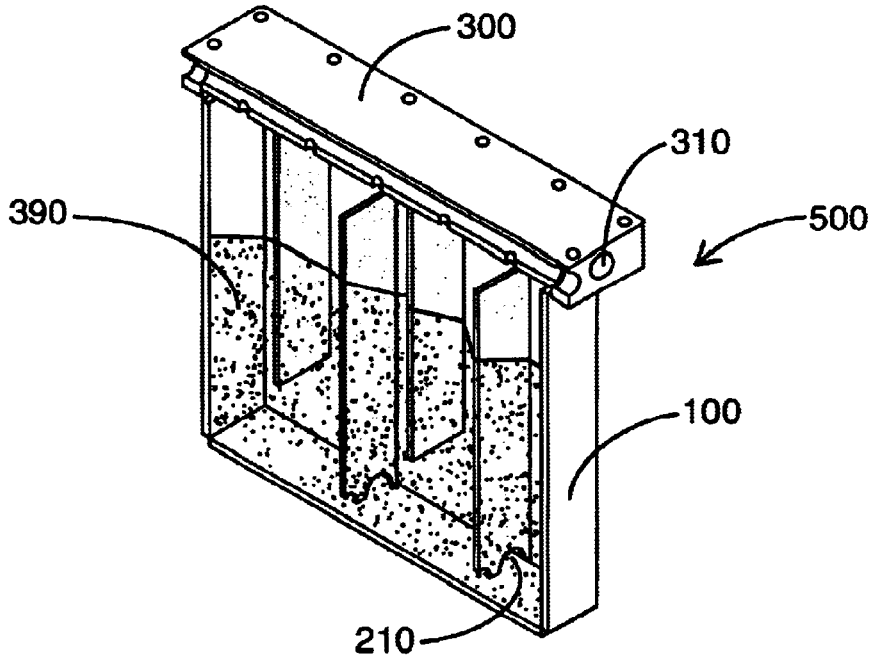
FIG. 7 is a perspective view illustrating the first embodiment of the humidifier in accordance with the present invention, filled with packing materials.

For the embodiment illustrated, the humidifier 500 is disposed in a substantially vertical position during operation. The water distributing portion 300 is mounted onto the open end of the housing 100, defining the inner surface or chamber 102 inside the housing as best seen in FIG. 7. The air inlet 110 and outlet 111 are connected to an air circulation loop (not shown). As shown in FIGS. 2 and 3, the air inlet 110 is provided on a side wall 140*a* at a position near the lower of the side wall 140*a* and near the side wall 120*a*. The air outlet 111 is provided on the same side wall 140*a* at a position near the upper of the side wall 140*a* and near the opposite side wall 120*b*. For the embodiment illustrated, the air inlet 110 and the air outlet 111 are arranged on side wall 140*a* substantially diagonal to each other. As previously disclosed the baffle plates 200*a*, 200*b* are arranged so that a baffle plate 200*a* is positioned near the air inlet 110 and a baffle plate 200*b* is positioned near the air outlet 111. This arrangement provides a long air flow path in the chamber 102 of the housing 110.

Air enters the chamber 102 through the air inlet 110 it flows upwardly along the height of the housing 100 between the first baffle plate 200*a* and the side wall 120. The air then flows through the opening 203 defined between the upper end 204 of the first baffle plate 200*a* and the water distribution portion 300 then downwardly along the height of the housing 100 between the first baffle plate 200*a* and the first baffle plate 200*b*. The air flows repeatedly in this manner between the respective baffle plates 200*a* and 200*b* until it exits the humidifier 500 through the air outlet 111. The arrangement of the air inlet 110, outlet 111 and the baffle plates 200*a*, 200*b* provides a tortuous flowing path for the air allowing the air to sufficiently contact the humidifying water. By providing a tortuous humidifying path the humidifier of the present invention can be compact.

The humidifying water is supplied from the ports 310 or 380 from any readily available sources and it can be pressurized or heated if desired. The humidifying water is sprayed from the nozzles 600 provided on the water distributing ports 350 in the form of mist to mix with the air flowing along the flow path described above. As water is continuously falling from the water distribution portion 300 into the housing 100, it can accumulate at the bottom portion of the chamber to a certain level. A plurality of apertures 210 are provided at the bottom ends 202 of the baffles plates 200*a* to allow water to flow across the bottom wall 160 of the housing 100 to the water outlet 114 through which it can be drained.

It is desirable to maintain the water height within the chamber 102 of the housing 100 at a certain level, for example, half of the height of the chamber 102. Therefore, a water level sensor 400 can be mounted onto the connector port 113 to monitor the water level in the chamber 102. Once the water level is below the level of the sensor, the sensor sends signals to a processor (not shown), which, in turn, adjusts the humidifying water flow.

A packing material 390 can be provided in chamber 102 between adjacent baffles plates, as can be best seen in FIG. 7. The packing material 390 can be metal chips, plastic chips or other suitable random or structured packing material. Since the packing material 390 has small internal passages, gas and water can flow through the packing material. Further, since the packing material 390 has a high surface to volume ratio, the contact area between the gas and the water is increased. The packing material may fill in, for example, half or ⅔ of the total volume of the chamber 102.

Figure 8:
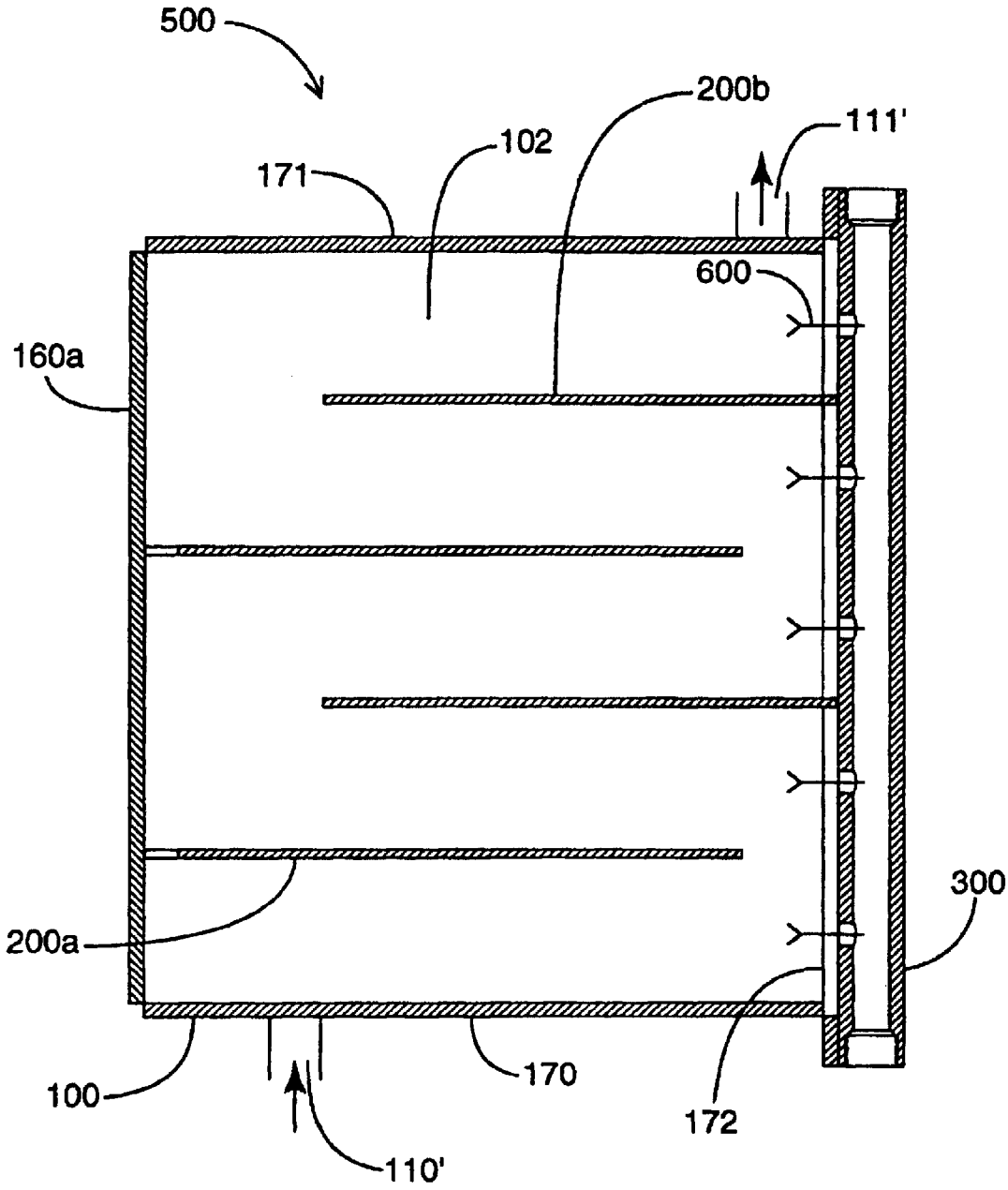
FIG. 8 is a longitudinal section view illustrating a second embodiment of the humidifier in accordance with the present invention.

Now referring to FIG. 8, a second embodiment of the humidifier of the present invention is shown. Similar components as in the first embodiment are indicated with same reference numbers. In the second embodiment, the housing 100 is rotated so that the open end 172 is provided on one side thereof. As in the first embodiment the water distributing portion 300 closes the open end 172. In this embodiment the baffle plates 200*a* and 200*b* are spaced from each other in the vertical direction. A plurality of water spraying nozzles 600 can be provided on the water distributing portion 300 to spray water into the chamber 102. For this embodiment the gas inlet 110' and a gas outlet 111' are provided respectively on the bottom wall 170 and the top wall 171 of the housing 100. It can be appreciated, however, that the gas inlet and outlet can be switched according to the type of gas the humidifier 500 is working with. For example, when the humidifier is used to humidify light gases, such as hydrogen, the arrangement of FIG. 8 is preferred. However, when working with heavy gases it might be desirable to use the gas outlet 111' as the inlet for the gas. The gas inlet and outlet can also be provided as in the first embodiment, if desired.

Figure 9:
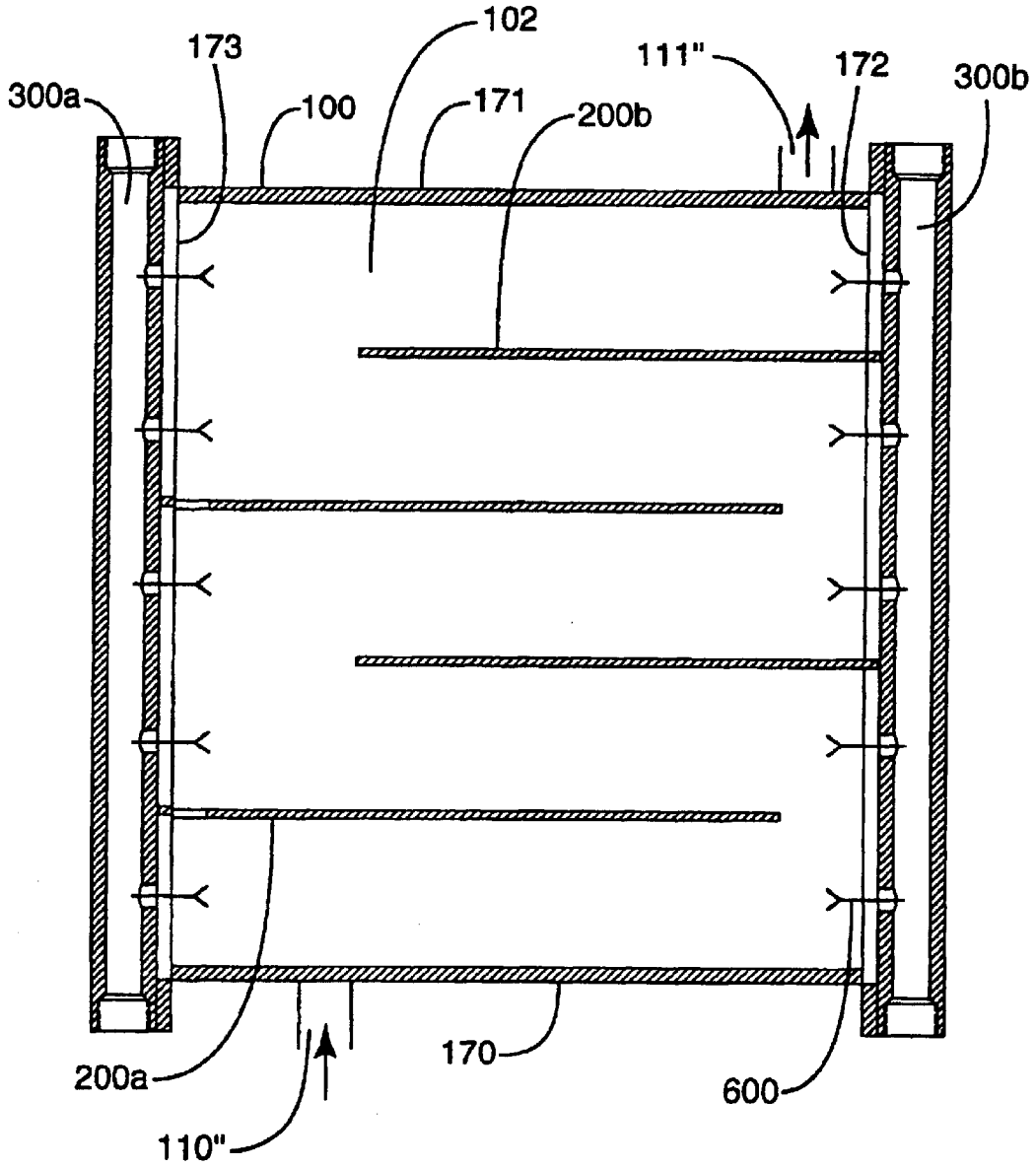
FIG. 9 is a longitudinal section view illustrating a third embodiment of the humidifier in accordance with the present invention.

A third embodiment of the humidifier 500 is shown in FIG. 9. This embodiment is similar to the embodiment disclosed in FIG. 8, except the housing 100 of the humidifier 500 is open as at 172 and 173 and has two water distributing portions 300*a* and 300*b*, respectively, to close the open ends 172 and 173 of the housing 100. A plurality of water spraying nozzles 600 can be provided on the water distributing portions 300*a* and 300*b* to spray water into the chamber 102. The gas inlet 110" and the gas outlet 111" can be provided as described for the embodiment illustrated in FIG. 8.

For both the second and third embodiments, a packing material can be provided in the chamber 102 of the housing 100 to increase the contact area between the gas and the water.

It is to be understood that the arrangement of the air inlet 110 and the air outlet 111 and the arrangement of the baffle plates 200*a*, 200*b* can be different from that disclosed in the preferred embodiments disclosed herein. For example, the air inlet 110 or the air outlet 111 can be provided on the side walls 120*a* or 120*b*. Further, the air inlet and the air outlet do not necessarily need to be provided on the same side wall. Moreover, although the present invention is described using a rectangular shaped housing for the humidifier as an example, the humidifier and the housing shape need not be this shape.

It should also be appreciated that the present invention is not limited to the embodiment disclosed herein. It can be anticipated that those having ordinary skills in the art can make various modification to the embodiments disclosed herein after learning the teaching of the present invention. For example, the number and arrangement of components in the system might be different, and different elements might be used to achieve the same specific function. However, these modifications should be considered to fall within the scope of the invention as defined in the following claims.

What is claimed is:

1. A humidifier, comprising:

a housing defining a chamber having at least one open end, the housing provided with a gas inlet connectable in fluid communication with a source of gas having a first moisture content and a gas outlet from connectable with a passageway for the withdrawal of a gas having a second moisture content greater than the first moisture content;

at least one fluid distributing portion disposed within the at least one open end of the housing to continuously distribute a fluid within the chamber; the at least one fluid distribution portion closing the at least one open end of the housing chamber to gas flow and at least one baffle disposed within the chamber to define a flow path for the gas between the gas inlet and the gas outlet;

and wherein, the gas absorbs at least a portion of the fluid as the fluid is being continuously distributed in the chamber thereby increasing the moisture content of the gas as it travels from the gas inlet towards the gas outlet.

2. A humidifier according to claim 1, wherein the at least one baffle comprises a plurality of baffles plates.

3. A humidifier according to claim 2, wherein the baffle plates are disposed within the chamber generally transverse to the fluid distributing portion and spaced from one another over a longitudinal extent of the fluid distributing portion.

4. A humidifier according to claim 3, wherein the extent of the baffle plates in the direction generally transverse to the fluid distributing portion is sufficient to define within the chamber gas flow paths adjacent the baffle plates.

5. A humidifier according to claim 4, wherein each baffle plate is provided with an opening to allow gas to flow between adjacent flow paths.

6. A humidifier according to claim 5, wherein the opening of a given baffle plate is at an end of the baffle plate that is opposed to the end of where an opening of an adjacent baffle plate is provided.

7. A humidifier according to claim 6, wherein at least some of the baffle plates are provided with an aperture to allow fluid to flow between adjacent flow paths.

8. A humidifier according to claim 5, wherein the opening is defined by spacing an end of the baffle plate from at least one of the fluid distributing portions and the inner walls of the chamber.

9. A humidifier according to claim 8, wherein adjacent baffle plates are offset with respect to one another in a direction generally transverse to the fluid distributing portion so that the opening of a given baffle plate is opposed to where an opening of an adjacent baffle plate is provided.

10. A humidifier according to claim 9, wherein at least some of the baffle plates are provided with an additional opening to allow fluid to flow between adjacent flow paths.

11. A humidifier according to claims 6 or 10, wherein the baffle plates are disposed within the chamber at generally 90° to the fluid distributing portion.

12. A humidifier according to claim 1, further comprising a packing material provided In the chamber.

13. A humidifier as claimed in claim 12, wherein the packing material fills two thirds of the chamber of the housing.

14. A humidifier according to claims 7 or 10, wherein the fluid distributing portion is provided with fluid spraying nozzles.

15. A humidifier according to claim 14, wherein the fluid distributing portion comprises at least one port for connection to an external source, at least one fluid distributing port to distribute a fluid to the chamber, and at least one fluid passage to connect the ports to the fluid distributing ports.

16. A humidifier according to claim 15, further comprising a fluid level sensor to monitor the fluid level in the chamber.

17. A humidifier according to claim 1, wherein the housing and the fluid distributing portion are generally rectangular in shape.

18. A humidifier according to claim 17, wherein the chamber is generally rectangular in shape.

19. A humidifier according to claim 18, wherein the gas inlet and the gas outlet are provided at opposite ends of the housing.

20. A humidifier according to claim 1, wherein the housing is disposed so that the at least one open end faces upwardly.

21. A humidifier as claimed in claim 1, wherein the housing is disposed so that at least one open end faces a side thereof.

22. A humidifier according to claim 1, wherein the housing is disposed so that one open end faces one side thereof and another open end faces an opposed side thereof.

23. A humidifier according to claims 20, 21, or 22 wherein the fluid distributing portion is disposed over the open end of the housing.

* * * * *

UNITED STATES PATENT AND TRADEMARK OFFICE

CERTIFICATE OF CORRECTION

PATENT NO. : 6,726,187 B2 
DATED : April 27, 2004
INVENTOR(S) : Jianming Ye, Todd A. Simpson and Joseph Cargnelli It is certified that error appears in the above-identified patent and that said Letters Patent is hereby corrected as shown below:

Column 5,
Lines 57 and 64, change “In” to -- in --.

Column 6,
Line 2, change “Internal” to -- internal --.

Column 8,
Line 5, delete “from”;
Line 11, change “chamber;” to -- chamber, --;
Line 13, after “flow” add -- ; --; and
Line 16, change “;” to -- , --.

Signed and Sealed this

Thirtieth Day of November, 2004

JON W. DUDAS
*Director of the United States Patent and Trademark Office*